United States Patent [19]

Oda et al.

[11] 4,341,612

[45] Jul. 27, 1982

[54] ELECTROLYTIC CELL

[75] Inventors: Yoshio Oda; Takeshi Morimoto; Kohji Suzuki, all of Yokohama, Japan

[73] Assignee: Asahi Glass Company, Limited, Tokyo, Japan

[21] Appl. No.: 152,351

[22] Filed: May 22, 1980

[30] Foreign Application Priority Data

Jun. 1, 1979 [JP] Japan ..... 54/67462

[51] Int. Cl.[3] ..... C25B 11/08; H01B 1/06

[52] U.S. Cl. ..... 204/253; 204/286; 204/290 R; 204/290 F; 204/291; 252/518

[58] Field of Search ..... 204/290 R, 290 F, 291, 204/267, 253, 286; 252/518

[56] References Cited

U.S. PATENT DOCUMENTS

| | | | |
|---|---|---|---|
| 3,801,490 | 4/1974 | Welch | 204/290 F |
| 4,056,452 | 11/1977 | Campbell | 204/258 |
| 4,057,479 | 11/1977 | Campbell | 204/258 |
| 4,124,539 | 11/1978 | Horowitz et al. | 252/518 |
| 4,146,458 | 3/1979 | Horowitz et al. | 204/277 |
| 4,163,706 | 8/1979 | Horowitz et al. | 204/242 |
| 4,191,618 | 3/1980 | Coker et al. | 204/98 |
| 4,210,501 | 7/1980 | Dempsey et al. | 204/129 |
| 4,224,121 | 9/1980 | Dempsey et al. | 204/98 |

FOREIGN PATENT DOCUMENTS

| | | |
|---|---|---|
| 1252643 | 7/1961 | Fed. Rep. of Germany . |
| 2348889 | 8/1974 | Fed. Rep. of Germany . |
| 2503652 | 8/1975 | Fed. Rep. of Germany . |
| 2704213 | 8/1977 | Fed. Rep. of Germany . |

*Primary Examiner*—F. Edmundson

*Attorney, Agent, or Firm*—Oblon, Fisher, Spivak, McClelland & Maier

[57] ABSTRACT

An electrolytic cell comprises two or more units wherein each unit comprises a gas and liquid permeable anode is closely brought into contact with one surface of a cation exchange membrane and a gas and liquid permeable cathode which is closely brought into contact with the other surface of the membrane; a gas and liquid permeable current collector which is closely brought into contact with a back surface of said anode; a gas and liquid permeable current collector which is closely brought into contact with a back surface of said cathode. A partition wall made of a cathode side conductor and an anode side conductor is used to contact said cathode side conductor with a current collector contacting with a cathode and to contact said anode side conductor with a current collector contacting with an anode and an electrolyte solution is fed into said current collector contacting with said anode and an electrolyzed solution is discharged from said current collector contacting with said cathode.

5 Claims, 1 Drawing Figure

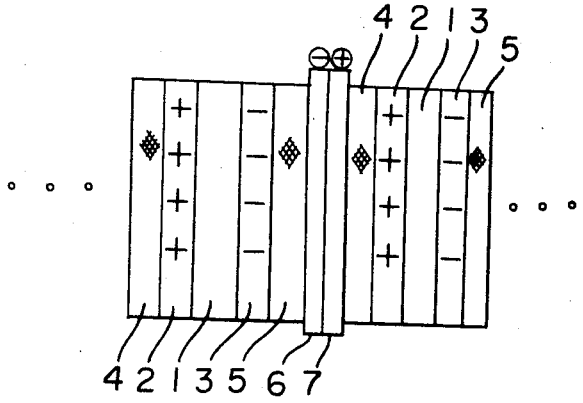
4 2 1 3
5
4 2 1 3 5 6 7

ELECTROLYTIC CELL

BACKGROUND OF THE INVENTION

1. Field of the Invention

The present invention relates to an electrolytic cell. More particularly, it relates to an electrolytic cell having a novel structure using a cation exchange membrane for producing an alkali metal hydroxide.

2. Description of the Prior Arts

In a process for producing an alkali metal hydroxide by an electrolysis of an aqueous solution of an alkali metal chloride, a cation exchange membrane process has been widely employed instead of the conventional mercury process in view of the public pollution.

Various processes using a cation exchange membrane for producing an alkali metal hydroxide having high concentration and high purity have been proposed instead of the process using an asbestos.

On the other hand, an energy saving has been required in the world to require a lower cell voltage in such technology in view of said energy saving.

As a method of lowering the cell voltage, substances and compositions and configurations of an anode and a cathode have been studied. Moreover, compositions of the cation exchange membrane and kinds of the ion exchange groups have been studied.

These proposed processes may have certain effects. Most of them, however, have relatively low, limitations of the maximum concentration of the alkali metal hydroxide. When the concentration of the alkali metal hydroxide is over the limitation, the cell voltage is suddenly increased and the current efficiency has been lowered. Moreover, the maintenance of the low cell voltage is not satisfactory. These are not industrially satisfactory.

Recently, it has been proposed to carry out an electrolysis by using a cell wherein a gas and liquid permeable anode is brought into contact with one surface of a fluorinated cation exchange membrane and a gas and liquid permeable cathode is brought into contact with the other surface of the membrane. This process is effective for performing an electrolysis at a lower cell voltage because an electric resistance of an electrolyte solution and an electric resistance caused by bubbles of hydrogen or chlorine gas can be remarkably lowered though it has been considered to be avoidable in such field.

Such proposals, however, is still conceptional and any industrial structure of the electrolytic cell has not been proposed as the industrial apparatus for said purposes.

SUMMARY OF THE INVENTION

It is an object of the present invention to provide an electrolytic cell used for said purposes which requires only small floor space and is a compact structure for a large scale.

The foregoing and other objects of the present invention have been attained by providing an electrolytic cell which comprises two or more units wherein each unit comprises a gas and liquid permeable anode which is closely brought into contact with one surface of a cation exchange membrane and a gas and liquid permeable cathode which is closely brought into contact with the other surface of the membrane; a gas and liquid permeable current collector which is closely brought into contact with a back surface of the anode; a gas and liquid permeable current collector which is closely brought into contact with a back surface of the cathode; an improvement characterized in that a partition wall made of a cathode side conductor and an anode side conductor is used to contact the cathode side conductor with the current collector contacting with the cathode and to contact the anode side conductor with the current collector contacting with the anode and an electrolyte solution is fed into the current collector contacting with the anode and an electrolyzed solution is discharged from the current collector contacting with the cathode.

The gas and liquid permeable anode is preferably made of a mixture of ruthenium oxide and an oxide of at least one metal of Sr, La, Ge, Sn, Pb, Ti, Zr, Sb, Bi, Nb, Ta, Mn, Fe, Co or Ni. The gas and liquid permeable anode can be also made of pyrochlore type complex oxide having the formula $$A_2Ru_2O_{7-x}$$

(A is Pb or Bi, Tl or rare earth elements and $0 \leqq x \leqq 1$) or perovskite type complex oxide having the formula $$BRuO_3$$

(B is Ca, Sr, Ba or La) or pyrochlore type complex oxide having the formula $$Tl_2Ru_{2-x}Ir_xO_7$$

($x=0.3-1.5$)

BRIEF DESCRIPTION OF THE DRAWING

FIG. 1 is a schematic view of an electrolytic cell of the present invention.

DETAILED DESCRIPTION OF THE PREFERRED EMBODIMENT

The structure of the electrolytic cell of the present invention will be briefly illustrated referring to FIG. 1 before the detailed description of the structure.

The reference numeral (1) designates a cation exchange membrane, and a gas and liquid permeable anode (2) is brought into contact with one surface of the membrane and a gas and liquid permeable cathode (3) is brought into contact with the other surface of the membrane. A gas and liquid permeable collector (4) is brought into contact with the back surface of the anode (2) opposite to the membrane and a gas and liquid permeable collector (5) is brought into contact with the back surface of the cathode (3) opposite to the membrane to form one unit. The reference numeral (6) designates a cathode side conductor and (7) designates an anode side conductor which is electrically connected to the cathode side conductor and the conductors (6), (7) to form a partition wall as one piece.

In FIG. 1, two units are used and the current collector (5) contacting with the cathode (3) in one unit is brought into contact with the cathode side conductor (6) and the current collector (4) contacting with the anode (2) in the other unit is brought into contact with the anode side conductor (7) to be in one piece. Thus, the units are respectively connected through each partition wall to form an electrolytic cell having desired chambers.

An aqueous solution of an alkali metal chloride is fed into the current collector (4) contacting with the anode (2). The plus terminal of a DC power source is connected to an anode terminal (not shown) at one end of the cell and the minus terminal is connected to a cathode terminal (not shown) at the other end of the cell as a conventional bipolar cell. Water is usually fed into the current collector (5) contacting to the cathode (3) to carry out the electrolysis whereby an electrolyzed solution is produced in the current collector (5).

A gas and liquid can be permeable into the current collectors (4), (5) whereby the gas formed at each electrode, the electrolyzed solution and the electrolyte solution can be freely moved.

The gas and liquid permeable electrodes used in the present invention can be porous electrodes for both the cathode and the anode. The physical properties of the cathode and the anode are preferably to have an average pore diameter of 0.01 to 1000$\mu$, a porosity of 20 to 95% and an air permeable coefficient of $1\times10^{-5}$ to 1 mole/cm$^2$. min.cmHg.

When the average pore diameter, the porosity and the air permeable coefficient are less than said ranges, hydrogen and chlorine gas formed by the electrolysis are not easily removed from the electrodes to cause high electric resistance. When they are more than said ranges, an effective electrode area is smaller to increase the contact resistance between the membrane and the electrode.

Among the average pore diameter, the porosity and the air permeability coefficient, it is preferable to have an average pore diameter of 0.05 to 500$\mu$; a porosity of 30 to 90% and an air permeable coefficient of $1\times10^{-4}$ to $1\times10^{-1}$ mole/cm$^2$.min.cmHg. The gas removability from the electrode is easy to be capable of a stable continuous operation for a long time.

In the electrolyte cell of the present invention, the electrodes are brought into contact with the cation exchange membrane, whereby higher anticorrosive property of the electrode is required in comparison with the usual electrolysis. The anode especially contacts with an alkali metal chloride, chlorine and an alkali metal hydroxide during the electrolysis under producing the alkali metal hydroxide in the cation exchange membrane at relatively high temperature to be highly corrosive atmosphere.

In order to provide a lower cell voltage in an electrolysis of an aqueous solution of an alkali metal chloride, an electrode having a chlorine resistance and an alkali resistance has been studied. As a result, it has been found that the electrode especially an anode made of the following substance is preferably used.

(1) A mixture of ruthenium oxide and an oxide of at least one metal of Sr, La, Ge, Sn, Pb, Ti, Zr, Sb, Bi, Nb, Ta, Mn, Fe, Co or Ni.

(2) A pyrochlore type complex oxide having the formula $$A_2Ru_2O_{7-x}$$

(A is Pb or Bi, Tl or rare earth elements and $0\leqq x\leqq 1$).

(3) A perovskite type complex oxide having the formula $$BRuO_3$$

(B is Ca, Sr, Ba or La).

(4) A pyrochlore type complex oxide having the formula $$Tl_2Ru_{2-x}Ir_xO_7$$

($x=0.3-1.5$).

The electrodes are further illustrated.

(1) A content of the oxide of the other metal is depending upon the kind of the oxide and is usually in a range of 1 to 70 mole% to ruthenium oxide. When it is less than said range, the anticorrosive property is not satisfactory whereas when it is more than said range, a low cell voltage for ruthenium oxide is prevented to be high cell voltage.

When it is in a range of 5 to 60 mole%, it has satisfactory anticorrosive property and the phenomenon for higher cell voltage is not substantially caused. When the oxide of Ge, Pb, Ti, Zr, Bi, Nb, Tl, Mn, Co or Ni is used, excellent anticorrosive property is obtained without a deterioration of the low cell voltage effect of ruthenium oxide.

(2) The pyrochlore type complex oxides ($A_2Ru_2O_{7-x}$) have special crystalline structure and X-ray refraction pattern as described in Mat. Res. Bull. 6, 669 (1971) by R. J. Bouchard. The oxides impart excellent properties for the anode in the electrolysis of an alkali metal chloride and also have high alkali resistance and high chlorine resistance required in the electrode contact type electrolysis.

(3) The perovskite type complex oxides are described in Mat. Res. Bull. Vol. 10 page 837 (1975) by H. S. Gandhi et. al. When the perovskite type complex oxide is used, an anode overvoltage is low and it has high alkali resistance and high chlorine resistance required in the electrode contact type electrolysis.

(4) The pyrochlore type complex oxides ($Tl_2Ru_{2-x}Ir_xO_7$) are superior to the oxides (2).

The preparation of the anode of the electrolytic cell for an electrolysis of an alkali metal chloride (made of said substance) is not critical and is preferably as follows.

Powder or grain of 200 to 500 mesh of said oxide is prepared and is admixed with a binder made of a fluorinated polymer such as polytetrafluoroethylene with a surfactant to obtain a paste. The paste is coated on a soluble sheet such as an aluminum foil and the coated layer is bonded to a cation exchange membrane at high temperature under a pressure and the aluminum foil is dissolved with an alkali metal hydroxide. In the preparation of the anode, it is possible to coat a suspension or a paste of said powder or grain of said complex oxide on a net or porous substrate made of Ti, Ta or Nb.

In the preparation of the electrolytic cell of the present invention, the anode is closely brought into contact with one surface of the cation exchange membrane and a gas and liquid permeable cathode is closely brought into contact with the other surface of the membrane. Each net made of platinum group metal or iron group metal is closely brought into contact with the anode and the cathode. The cathode is prepared as that of the anode by using a material for the cathode which can be a platinum group metal such as Pt, Ru or Rh or an alloy thereof, graphite, nickel, or stainless steel, etc. A porous plate can be formed by the powder, a net or superposed layers or a plate having many through holes can be used.

When the anode or the cathode is closely brought into contact with the cation exchange membrane, the electrode can be heat-pressed on the membrane.

The configuration of the current collector being brought into contact with the anode or the cathode, can be a plurality of nets or rods assembled so as to be gas and liquid permeable or can be a porous plate.

When the net or the porous plate is used, it is suitable to have an average pore diameter of 100μ to 5 mm and a porosity of 50 to 98%. When rods are arranged, it is preferable to give similar physical property.

The current collector should be the gas and liquid permeable and the conductor for the electrode. It is not preferable to be out of said range because a part or whole of said object of the present invention has not been attained.

The substrate for the current collector in the anode side can be made of Ti, Zr, Nb or Ta and the substrate for the current collector in the cathode side can be made of Ni or stainless steel.

In the partition wall made of the anode side conductor and the cathode side conductor, the former can be made of Ti, Zr, Nb or Ta and the latter can be Ni, stainless steel or Fe. These conductors are electrically connected by a welding or an explosion welding etc.

The partition walls have preferably deep protrusion or many vertical grooves so as to pass an electrolyte solution through the current collectors. The partition can be prepared by an exprosion welding of two kinds of metal plates or a coating of an alkali resistant metal on a metal substrate.

The cation exchange membrane used in the present invention can be made of a polymer having cation-exchange groups such as carboxylic acid group, sulfonic acid group, phosphoric acid group and phenolic hydroxy group. Suitable polymers include copolymers of a vinyl monomer such as tetrafluoroethylene and chlorotrifluoroethylene; and a perfluorovinyl monomer having an ion-exchange group such as sulfonic acid group, carboxylic acid group and phosphoric acid group or a reactive group which can be converted into the ionexchange group. It is also possible to use a membrane of a polymer of trifluoroethylene in which ion-exchange groups such as sulfonic acid group are introduced.

It is especially preferable to use monomers for forming the following units (a) and (b) in the copolymer.

$$\left(CF_2-CXX'\right) \quad \text{(a)}$$

$$\left(CF_2-\underset{\underset{Y}{|}}{C}X\right) \quad \text{(b)}$$

wherein X represents fluorine, chlorine or hydrogen atom or $-CF_3$; X' represents X or $CF_3(CF_2)_m$; m represents an integer of 1 to 5 and Y represents -A, -ϕ-A, -p-A or $-O-(CF_2)_n(P,Q,R)-A$; P represents $(CF_2)_a(CXX')_b(CF_2)_c$; Q represents $(CF_2\text{-}O\text{-}CXX')_d$, and R represents $(CXX'\text{-}O-CF_2)_e$, (P,Q,R) represents at least one of P, Q and R arranged in a desired order; ϕ represents phenylene group; X and X' are defined above; n is 0 to 1 and a, b, c, d and e are respectively 0 to 6; A represents —COOH, —CN, —COF, $-COOR_1$, —COOM, $-CONR_2R_3$ or a reactive group which can be converted into —COOH by a hydrolysis or neutralization; R represents a $C_1$–$C_{20}$ alkyl group; M represents an alkali metal or quaternary ammonium group; $R_2$ and $R_3$ represent H or a $C_1$–$C_{10}$ alkyl group.

The typical examples of Y have the structures bonding A to a fluorocarbon group such as $$\left(CF_2\right)_x-A,\ -O\left(CF_2\right)_x-A,\ \left(O-CF_2-\underset{\underset{Z}{|}}{C}F\right)_y A,$$

$$\left(O-CF_2-\underset{\underset{Z}{|}}{C}F\right)_x\left(O-CF_2-\underset{\underset{Rf}{|}}{C}F\right)_y A \text{ and}$$

$$-O-CF_2\left(\underset{\underset{Z}{|}}{C}F-O-CF_2\right)_x\left(CF_2\right)_y\left(CF_2-O-\underset{\underset{Rf}{|}}{C}F\right)_z A$$

x, y and z respectively represent an integer of 1 to 10; Z and Rf represent —F or a $C_1$–$C_{10}$ perfluoroalkyl group; and A is defined above.

When a fluorinated cation exchange membrane having a carboxylic acid group content of 0.5 to 2.0 meq/g.dry resin which is made of said copolymer is used, the desired object of the present invention is especially, satisfactorily attained.

When such membrane is used, a current efficiency can be higher than 90% even though a concentration of sodium hydroxide is more than 40%.

When the carboxylic acid group content is in a range of 1.12 to 1.7 meq/g.dry resin, the object of the present invention is especially attained in stable to give excellent durability and life.

In order to give such ion-exchange capacity, a ratio of the units (b) in the copolymer of the units (a) and the units (b) is preferably in a range of 1 to 40 mole % especially 3 to 25 mole %.

The ion-exchange resin membrane used for the present invention is preferably made of a non-crosslinked copolymer of a fluorinated olefin monomer and a monomer having carboxylic acid group or a functional group which can be converted into carboxylic acid group. A molecular weight of the copolymer is preferably in a range of about 100,000 to 2,000,000 especially 150,000 to 1,000,000.

In the preparation of such copolymer, one or more abovementioned monomers can be used with a third monomer so as to improve the membrane. For example, a flexibility of the membrane can be imparted by incorporating $CF_2=CFORf$ (Rf is a $C_1$–$C_{10}$ perfluoroalkyl group), or a mechanical strength of the membrane can be improved by crosslinking the copolymer with a divinyl monomer such as $CF_2=CF-CF=CF_2$ or $CF_2=CFO(CF_2)_{1\text{-}3}CF=CF_2$.

The copolymerization of the fluorinated olefin monomer and a monomer having carboxylic acid group or a functional group which is convertible into carboxylic acid group, can be carried out by a desired conventional process. The polymerization can be carried out if necessary, using a solvent such as halohydrocarbons by a catalytic polymerization, a thermal polymerization or a radiation-induced polymerization. A fabrication of the ion-exchange membrane from the resulting copolymer is not critical, for example it can be known-methods such as a press-molding method, a roll-molding method, an extrusion-molding method, a solution spreading method, a dispersion molding method and a powder molding method.

The thickness of the membrane is preferably 20 to 500 microns especially 50 to 400 microns.

When the functional groups of the fluorinated cation exchange membrane are groups which can be converted to carboxylic acid groups, the functional groups can be converted to carboxylic acid groups (COOM) by suitable treatment depending upon the functional groups before the membrane being used in electrolysis, preferably after the fabrication.

When the functional groups are —CN, —COF, —$COOR_1$, —COOM, —$CONR_2R_3$ (M, $R_1$ to $R_3$ are defined above), the functional groups can be converted to carboxylic acid groups (COOM) by hydrolysis or neutralization with an acid or an alcoholic aqueous solution of a base.

When the functional group is double bonds, they are converted into carboxylic acid groups by reacting them with $COF_2$.

The cation exchange membrane used in the present invention can be fabricated by blending a polyolefin such as polyethylene, polypropylene, preferably a fluorinated polymer such as polytetrafluoroethylene and a copolymer of ethylene and tetrafluoroethylene.

A cloth, net, nonwoven fabric or porous film made of such polymer can be used as a supporter or wires, net or porous sheet made of a metal can be used as a supporter to reinforce the membrane.

The cation exchange membrane, the electrodes and the current collectors can be closely brought into contact each other by fastening them with frames and bolts as a filter-press structure or by heat-pressing or by mutually pressing with springs etc.

These elements can be connected to the partition walls by fastening or welding as mentioned above.

The electrolyte solution can be fed into the current collectors through branched pipes for the corresponding current collectors (the branched pipes are branched from one main pipe). The electrolyzed solution can be discharged through the similar branched pipes having the similar structure.

A gas-liquid separation can be carried out by placing a gas-liquid separator above the electrolytic cell. A gas-liquid separation can be also attained out of the electrolytic cell.

The electrolyte solution can be an aqueous solution of an alkali metal halide such as sodium chloride, potassium chloride or a sulfate such as sodium sulfate or hydrochloric acid.

The present invention will be further illustrated by certain examples and references which are provided for purposes of illustration only and are not intended to be limiting the present invention.

EXAMPLE 1

Into 20 ml. of water, 2.08 g. of ruthenium chloride was dissolved and 0.54 g. of germanium tetrachloride was added and the mixture was heated with stirring and concentrated to dryness. The resulting solid was pulverized and calcined at 500° C. for 1 hour. The resulting product is a mixture of oxides of Ru and Ge at an atomic ratio of Ru: Ge of 1:0.25. Then, 50 mg. of the oxides was admixed with 2.5 mg. of polytetrafluoroethylene dispersion (Teflon 30 J made by E. I. DuPont) and the mixture was coated on an aluminum foil and calcined at 360° C. for 2 hours. The aluminum foil was dissolved to obtain a plate having an area of 10 $cm^2$. This was used as an anode. The anode had an average pore diameter of 1$\mu$ and a porosity of 65%.

In accordance with the process for the preparation of the anode except using 50 mg. of Raney nickel, a cathode was prepared. The cathode had an average pore diameter of 3$\mu$, a porosity of 70%. The anode and the cathode were bonded on different surfaces of a cation exchange membrane made of a copolymer of $C_2F_4$ and $CF_2{=}CFO(CF_2)_3COOCH_3$ having an ion exchange capacity of 1.45 meq/g. dry resin and a thickness of 250$\mu$, at 160° C. under a pressure of 30 kg/$cm^2$. The product was dipped in an aqueous solution of sodium hydroxide (25 wt. %) at 90° C. for 16 hours to hydrolyze the cation exchange membrane. Each platinum net as the current collector was brought into contact with each of the cathode and the anode under a pressure. A partition was made by explosion welding of a stainless steel plate and a titanium plate and each outer surface of said plates had deep protrusion. One current collector of one unit was welded on the wall of the stainless steel plate of the partition and the other current collector of said unit was welded on the wall of the titanium plate of the other partition so as to form a serial connection of ten pairs of the units and the partitions. 5 N aqueous solution of NaCl was fed into the anode compartment and water was fed into the cathode compartment to carry out the electrolysis under maintaining a concentration of sodium hydroxide of the catholyte at 35 wt. %. The results are as follows.

| Current density (A/$dm^2$) | Cell voltage (each unit) (V) |
|---|---|
| 10 | 2.73 |
| 20 | 2.96 |
| 30 | 3.12 |

EXAMPLES 2 TO 20

In accordance with the process of Example 1 except using zirconium chloride, titanium chloride, tantalum chloride, niobium chloride, stannous chloride, antimony chloride, manganese nitrate, ferric nitrate, cobalt nitrate, nickel nitrate, lead nitrate or bismuth nitrate or a mixture thereof, to give each mixture of oxides having atomic ratio shown in Table, each anode was prepared by using said mixture of oxides and each electrolytic cell was prepared and each electrolysis was carried out at 20 A/$dm^2$. The cell voltages (each unit) are as follows. The cathode was the same with that of Example 1. The anodes had an average pore diameter of 1.1 to 8.3$\mu$ and a porosity of 40 to 85%.

| Example | Composition | Cell voltage (each unit) (V) |
|---|---|---|
| 2 | Ru:Zr = 1:0.2 | 2.90 |
| 3 | Ru:Ti = 1:0.3 | 2.95 |
| 4 | Ru:Ta = 1:0.4 | 2.98 |
| 5 | Ru:Nb = 1:0.2 | 3.01 |
| 6 | Ru:Sn = 1:0.1 | 3.05 |
| 7 | Ru:Sb = 1:0.2 | 3.04 |
| 8 | Ru:Mn = 1:0.3 | 3.02 |
| 9 | Ru:Fe = 1:0.4 | 3.08 |
| 10 | Ru:Co = 1:0.2 | 3.02 |
| 11 | Ru:Ni = 1:0.2 | 2.94 |
| 12 | Ru:Pb = 1:0.3 | 2.93 |
| 13 | Ru:Bi = 1:0.4 | 2.99 |
| 14 | Ru:Ti:Zr = 1:0.2:0.1 | 2.89 |
| 15 | Ru:Ge:Bi = 1:0.25:0.10 | 2.88 |
| 16 | Ru:Pb:Ni = 1:0.20:0.20 | 2.87 |
| 17 | Ru:Ti:Co = 1:0.15:0.15 | 2.89 |
| 18 | Ru:Ti:Zr:Bi = 1:0.2:0.15:0.5 | 2.84 |
| 19 | Ru:Ge:Ni:Co = 1:0.3:0.1:0.1 | 2.83 |
| 20 | Ru:Nb:Pb:Mn = 1:0.25:0.15:0.1 | 2.82 |

As a reference, the anode was prepared by using only ruthenium oxide and the electrolysis was carried out. The initial cell voltage (each unit) was 2.95 V but the cell voltage (each unit) was gradually increased to cause a dissolution of the anode to change the catholyte in blue color.

EXAMPLE 21

Into 50 ml. of water, 73 mg. of $Pb_2Ru_2O_{6.5}$ powder (325 mesh) was dispersed and the polytetrafluoroethylene dispersion (Teflon 30 J) was admixed to give a content of polytetrafluoroethylene of 7.3 mg. and one drop of a surfactant was added and the mixture was cooled with ice and mixed by an ultrasonic mixer. The mixture was deposited on a porous polytetrafluoroethylene membrane by a suction filtration to support $Pb_2Ru_2O_{6.5}$ at a rate of 5 mg/cm$^2$ as an anode thin layer on the porous polytetrafluoroethylene membrane.

A cathode thin layer was also formed on a porous polytetrafluoroethylene membrane by depositing Raney nickel at a rate of 7 mg/cm$^2$.

These two thin layers were plied on each surface of the cation exchange membrane of Example 1 at 150° C. under 25 kg/cm$^2$ to contact the electrode layers with the cation exchange membrane and then, the porous polytetrafluoroethylene membranes were peeled off. The cation exchange membrane having the cathode and the anode was dipped in an aqueous solution of sodium hydroxide (25 wt.%) at 90° C. for 16 hours to hydrolyze the cation exchange membrane. Nickel and platinum nets as the current collectors were plied on the cathode and the anode under a pressure. A partition was made by explosion welding of a stainless steel plate and a titanium plate and each outer surface of said plates had many vertical grooves. One current collector of one unit was welded on the wall of the stainless steel plate of the partition and the other current collector of said unit was welded on the wall of the titanium plate of the other partition so as to form a serial connection of ten pairs of the units and the partitions. 4 N aqueous solution of NaCl was fed into the anode compartment and water was fed into the cathode compartment to carry out the electrolysis under maintaining a concentration of sodium hydroxide of the catholyte at 35 wt.%. The results are as follows.

| Current density (A/dm$^2$) | Cell voltage (each unit) (V) |
|---|---|
| 10 | 2.75 |
| 20 | 2.85 |
| 30 | 3.05 |
| 40 | 3.25 |

The current efficiency at the current density of 20 A/dm$^2$ was 94%. When the electrolysis was continued for 100 days at 20 A/dm$^2$, the cell voltage (each unit) was 2.87 V.

EXAMPLE 22

In accordance with the process of Example 21 except using $Bi_2Ru_2O_7$ as the oxide for the anode, 10 of the unit of the anode, the cathode, the cation exchange membrane, the current collectors and the partition wall were prepared and the electrolysis of NaCl was carried out at a current density of 20 A/dm$^2$. The cell voltage (each unit) was 2.83 Volt and the current efficiency was 93%.

EXAMPLE 23

In accordance with the process of Example 21 except using $Tl_2Ru_2O_7$ (325 mesh) as the oxide for the anode, 10 of the units of the anode, the cathode, the cation exchange membrane, the current collectors and the partition wall were prepared and the electrolysis of NaCl was carried out. The results are as follows.

| Current density (A/dm$^2$) | Cell voltage (each unit) (V) |
|---|---|
| 10 | 2.69 |
| 20 | 2.81 |
| 30 | 3.00 |
| 40 | 3.19 |

The current efficiency at the current density of 20 A/dm$^2$ was 96%. When the electrolysis was continued for 100 days at 20 A/dm$^2$, the cell voltage (each unit) was 2.82 V.

EXAMPLES 24 TO 27

In accordance with the process of Example 21 except using eachh pyrochlore complex oxide of $Lu_2Ru_2O_7$, $Nd_2Ru_2O_7$, $Eu_2Ru_2O_7$ or $Nd_{0.8}Bo_{1.2}Ru_2O_7$ as the oxide for the anode, the preparation of the anode and the electrolytic cell and the electrolysis were carried out at a current density of 20 A/dm$^2$. The results are as follows.

| Example | Anode | Cell voltage (each unit) (V) | Current efficiency (%) |
|---|---|---|---|
| 24 | $Lu_2Ru_2O_7$ | 2.93 | 93 |
| 25 | $Nd_2Ru_2O_7$ | 3.05 | 95 |
| 26 | $Eu_2Ru_2O_7$ | 3.12 | 92 |
| 27 | $Nd_{0.8}Bo_{1.2}Ru_2O_7$ | 2.94 | 94 |

EXAMPLE 28

In accordance with the process of Example 21 except using perovskite complex oxide of $SrRuO_3$ as the oxide for the anode, the preparation of the anode and the electrolytic cell and the electrolysis were carried out. The results are as follows.

| Current density (A/dm$^2$) | Cell voltage (each unit) (V) |
|---|---|
| 10 | 2.71 |
| 20 | 2.83 |
| 30 | 3.03 |
| 40 | 3.21 |

The current efficiency at the current density of 20 A/dm$^2$ was 95%. When the electrolysis was continued for 100 days at 20 A/dm$^2$, the cell voltage (each unit) was 2.84 V.

EXAMPLE 29 TO 31

In accordance with the process of Example 21 except using each perovskite complex oxide of $CaRuO_3$, $BaRuO_3$ or $LaRuO_3$, as the oxide for the anode, the preparation of the anode and the electrolytic cell and the electrolysis were carried out at a current density of 20 A/dm$^2$. The results are as follows.

| Example | Anode | Cell voltage (each unit) (V) | Current efficiency (%) |
|---|---|---|---|
| 29 | $CaRuO_3$ | 2.86 | 94 |
| 30 | $BaRuO_3$ | 2.84 | 95 |
| 31 | $LaRuO_3$ | 2.82 | 93 |

EXAMPLE 32

In accordance with the process of Example 21 except using $Tl_2Ru_{1.3}Ir_{0.7}O_7$ (less than 44μ) as the oxide for the anode, the preparation of the anode and the electrolytic cell and the electrolysis were carried out at a current density of 20 A/dm$^2$.

At the initiation, the cell voltage (each unit) was 2.77 V and the current efficiency was 92%. After the electrolysis for 3000 hours, the cell voltage (each unit) was 2.85 V and the current efficiency of 92%.

We claim:

1. An electrolytic cell, comprising:

two or more units, wherein each unit comprises a gas and liquid permeable anode wherein said anode contacts one surface of a cation exchange membrane and wherein said anode is made of a pyrochlore type complex oxide having the formula $Tl_2Ru_{2-x}Ir_xO_7$ wherein x is from 0.3 to 1.5, a gas and liquid permeable cathode wherein said cathode contacts the other surface of said membrane, a first gas and liquid permeable current collector which closely contacts a back surface of said anode, a second gas and liquid permeable current collector which closely contacts a back surface of said cathode, and a partition wall made of an anode side conductor and a cathode side conductor wherein said anode said conductor contacts said first current collector and said anode side conductor contacts said second current collector.

2. The electrolytic cell according to claim 1 wherein said anode side conductor of said partition wall is made of Ti, Zr, Nb or Ta and said cathode side conductor of said partition wall is made of Ni, stainless steel or iron.

3. The electrolytic cell according to claim 1 wherein said anode has an average pore diameter of 0.01 to 1,000μ a porosity of 20 to 95% and an air permeable coefficient of $1\times10^{-5}$ to 1 mole/cm$^2$ min.cmHg.

4. The electrolytic cell according to claim 1 wherein said current collector is in a form of a plurality of rods, or nets or a porous plate.

5. The electrolytic cell according to claim 1 wherein said partition wall is plied plates and a chlorine resistance metal is supported on a plate made of nickel, stainless steel or iron.

* * * * *